US008469181B2

(12) United States Patent
Figarski et al.

(10) Patent No.: US 8,469,181 B2
(45) Date of Patent: Jun. 25, 2013

(54) STORE-TRANSPORT DEVICE FOR ELONGATED ROD SHAPED ELEMENTS

(75) Inventors: Jacek Figarski, Szydlowiec (PL); Leszek Sikora, Radom (PL); Radoslaw Owczarek, Radom (PL)

(73) Assignee: International Tobacco Machinery Poland SP.ZO.O, Radom (PL)

( * ) Notice: Subject to any disclaimer, the term of this patent is extended or adjusted under 35 U.S.C. 154(b) by 0 days.

(21) Appl. No.: 13/381,780

(22) PCT Filed: Jul. 15, 2010

(86) PCT No.: PCT/PL2010/000060
§ 371 (c)(1),
(2), (4) Date: Dec. 30, 2011

(87) PCT Pub. No.: WO2011/019291
PCT Pub. Date: Feb. 17, 2011

(65) Prior Publication Data

US 2012/0125737 A1 May 24, 2012

(30) Foreign Application Priority Data

Aug. 14, 2009 (PL) ..... 388808

(51) Int. Cl.
*B65G 21/14* (2006.01)

(52) U.S. Cl.
USPC ..... 198/812; 198/347.1

(58) Field of Classification Search
USPC ..... 198/347.1, 347.2, 347.3, 588, 594, 198/812
See application file for complete search history.

(56) References Cited

U.S. PATENT DOCUMENTS

| | | | |
|---|---|---|---|
| 3,261,450 | A | 7/1966 | McCombie et al. |
| 3,297,138 | A | 1/1967 | McCombie |

(Continued)

FOREIGN PATENT DOCUMENTS

| | | | |
|---|---|---|---|
| EP | 1 935 813 | A1 | 6/2008 |
| GB | 995 663 | A | 6/1965 |
| GB | 2 007 179 | A | 5/1979 |
| GB | 2 143 788 | A | 2/1985 |

OTHER PUBLICATIONS

International Search Report of PCT/PL2010/000060, mailing date Nov. 23, 2010.
Written Opinion of PCT/PL2010/000060, mailing date Nov. 23, 2010.

*Primary Examiner* — James R Bidwell
(74) *Attorney, Agent, or Firm* — Westerman, Hattori, Daniels & Adrian, LLP

(57) ABSTRACT

A device having a variable-capacity store (3) formed with the aid of conveyors on two neighboring levels having one input channel (1), formed by a lower conveyor (4) and an upper conveyor (5), and one output channel (2), formed by an upper conveyor (6) and a lower conveyor (7), having a back plate (12), which is coupled with a slide (16) separating the levels of the store (3), equipped with a separating conveyor (17) so that they jointly effect to and fro motion, parallel to the horizontal conveyors, with the surface of the back plate (12), concave on the side of the store (3), is formed a the chain conveyor (13), characterized by the fact that the upper input conveyor (5) has at the end an arched part (8) pointing upwards, and the lower output conveyor (7) has at the beginning an arched part (9) pointing downwards, so that the two conveyors (5 and 7) approach each other with the arched parts (8 and 9).

16 Claims, 4 Drawing Sheets

Figure 1:
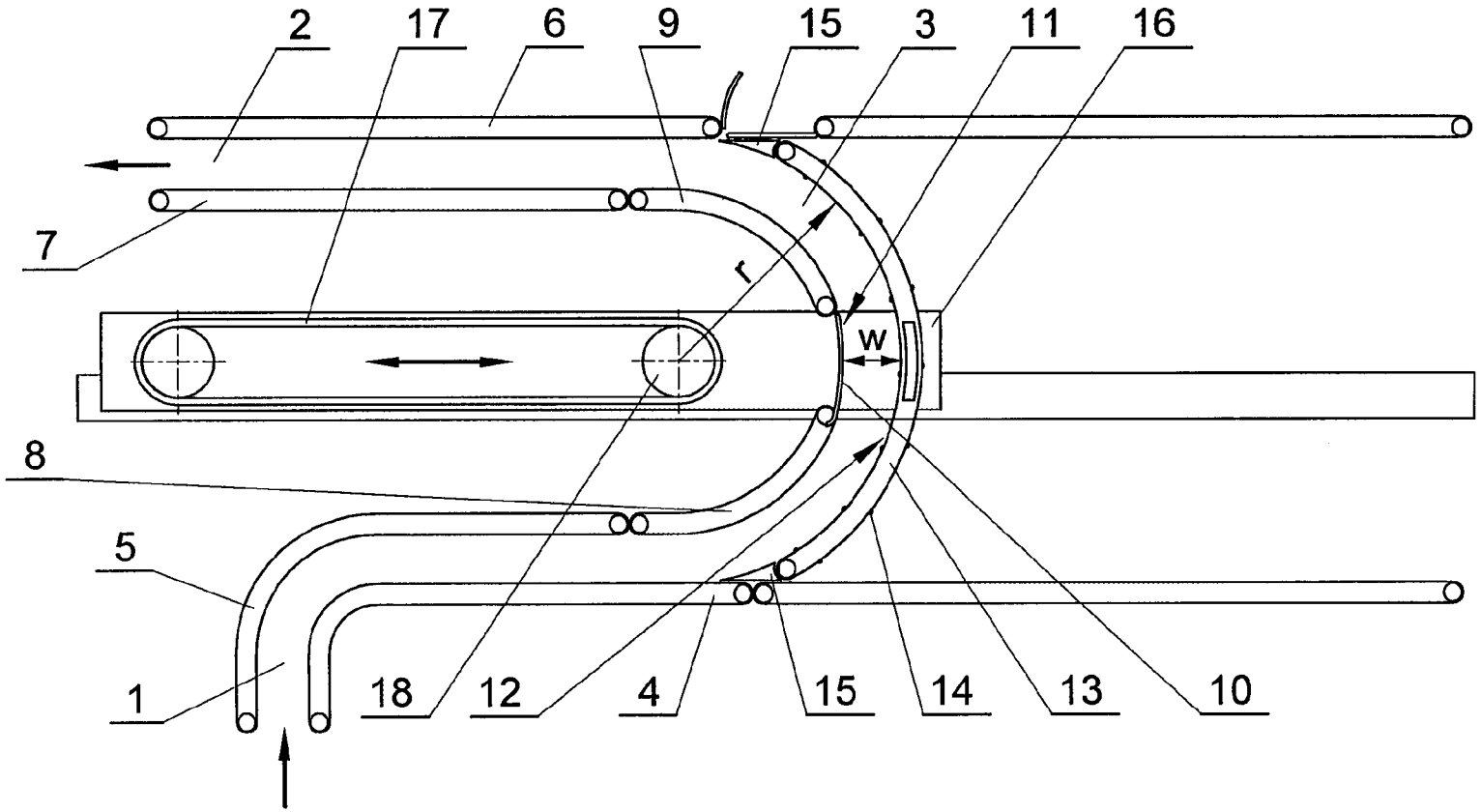

U.S. PATENT DOCUMENTS 3,565,237 A * 2/1971 Strydom ..... 198/572
3,605,988 A 9/1971 McCombie
4,078,648 A 3/1978 Hinchcliffe et al.
4,231,461 A 11/1980 Hinchcliffe et al.
4,813,527 A * 3/1989 Carter ..... 198/347.1
6,390,273 B1 * 5/2002 Muller ..... 198/347.1
7,341,141 B2 * 3/2008 Spatafora ..... 198/812
8,327,996 B2 * 12/2012 Gielniewski et al. ..... 198/347.1
2008/0149462 A1 6/2008 Cholet et al.

* cited by examiner

STORE-TRANSPORT DEVICE FOR ELONGATED ROD SHAPED ELEMENTS

The object of the invention is a store-transport device for elongated rod shaped elements, particularly products of the tobacco industry, designated to be placed in a line manufacturing the said products between a delivery device and a receiving device.

In the manufacture or processing in the tobacco industry of elongated rod shaped elements, particularly filter bars, there is a need for applying, on the route of mass flow, in-between storage compensating temporary inequality between the number of bars arriving from the delivery device and the number of bars taken in by the receiving device. For technical reasons, the best storage units are those, which apply the principle "first in-first out", permitting full control of product flow in the production line, and especially the control of the time of the filter bars remaining in storage. Large, and therefore costly buffer stores of variable capacity, for example, a store presented in U.S. Pat. No. 6,422,380, are not intended for use in the case of frequent changes in the range of filter bars, since prior to a change, there is still a large number of bars in storage, which will constitute production rejects. The British patent specification No. GB 995 663 describes a device for transporting cigarettes from the manufacturing machine to the packing machine. The device has a store divided into an upper part, to which cigarettes are supplied from the manufacturing machine, and a lower part from which the cigarettes are removed to the packing machine. The end of the store is a back plate, semicircular in shape, the radius of the plate, concave from the side of the store, corresponds to the height of each of the levels of the store, and the width of the store is slightly larger than the length of cigarettes being transported. Both the channel delivering the cigarettes, the inlet and the bottom of the upper and lower parts, and the outlet of the store are equipped with conveyors, which displace the stacked cigarettes. Similarly, a conveyor surrounds the concave surface of the back plate of the store. Between the back plate and the conveyor which forms the bottom of the upper part of the store there is a throat of fixed width, permitting mass flow of cigarettes into the lower part of the store. The back plate is permanently attached to a trolley, in which the said throat is formed, and to which, on the other side of the throat, a check roller of the conveyor of the upper part of the store is attached, the conveyor being able to change its length, depending on the demand for storage capacity. With the demand for greater storage capacity, the trolley with the back plate, throat and conveyor move towards the direction more distant from the inlet, and upon reduction of the demand for storage capacity, the trolley moves towards the outlet, with sensors controlling volume changes being located at the inlet and outlet of the store. Storage capacity is determined by stoppage or slowdown in the manufacturing and/or packing machine. The structure closest to the present invention is a storage-transport unit for elongated rod shaped elements, presented in the specification of Polish invention No. P-385206, which is placed in the line of displacing the elements from a delivery device and a receiving device, and has a number of conveyors, in principle horizontal and in principle vertical, and also has a variable-capacity store formed on two adjacent levels by the said conveyors, with one entrance and one exit, closed by a joint back plate, which is slidably mounted so that it performs reciprocating motion parallel to the horizontal conveyors, and the surface of which, concave on the side of the store, is constituted by a chain conveyor. The unit is equipped with a rotary lever attached to the slide, whose axis of rotation coincides with the concave curvature of the back plate permanently attached to the slide, and a swing input valve element and a swing limiter of the displacement of rod shaped elements are mounted at the inlet to the store, while a swing output valve element is mounted at the outlet of the store. The length of the rotary lever corresponds to the radius of curvature of the concave surface of the back plate, which is attached to the slide at a distance corresponding to the length of the rotary lever. The rotary lever is equipped on both sides with fullness sensors of rod shaped elements of mass flow in the area adjacent to the said lever. Both the operating surface of the input valve element and the operating area of the output surface of the output valve element are a section of a circle with a radius corresponding to the radius of curvature of the concave surface of the back plate. Between the axis of rotation of the rotary lever and the concave surface of the back plate, there is an empty space in the slide, which is a throat for displacement of rod shaped elements between the levels of the store, and on horizontal surfaces of the remaining part of the slide an internal conveyor is positioned, whereas an inclined conveyor is located above the inner conveyor before the outlet of the store. The upper plate of the store is the upper conveyor, and the lower plate of the store is the lower conveyor. The channel carrying rod shaped elements to the inlet of the store consists of two parallel input conveyors and the channel receiving rod shaped elements from the outlet of the store consists of two parallel output conveyors. Between the upper conveyor and the upper conveyor of the store, a swing top cover with location sensor is positioned. The individual movable components, and/or groups of moving components are driven independently by separate motors. After filling the initial store chamber with rod shaped elements displaced from the delivery channel through inlet to the store, which is signaled by the swing limiter raised to the extreme upper position with the input valve element removed, whereas the front face of the mass flow rests against the rotary lever situated in the lower vertical position, at a signal received from the swing limiter the said lever moves rotationally towards the back plate at a speed adjusted to the speed of the flow of rod shaped elements to the store entry, with simultaneous activation of the movement of the conveyor chain of the back plate, equipped with transverse humps and assisting in mass flow through the throat of the slide. After filling a minimum store space, the rotating lever stops at a horizontal position along the slide, followed by removal of the output valve element from the outlet from the store, so that the front face of the mass flow enters the receiving channel with the angular conveyor and the output conveyors of the output channel activated. Automatic capacity increase of the variable-capacity store occurs in case of higher productivity of the delivery device than the productivity of the receiving device, which makes the slide move with the back plate in the direction compliant with the direction of displacement of rod shaped elements through the inlet of the store from the inlet channel at such speed of flow, so as to keep the nominal pressure of mass flow at the outlet of the store, with the rotating lever remaining in a horizontal position along the slide, and the slide's inner conveyor with the inclined conveyor, as well as the upper and lower conveyors of the store's plates, the chain conveyor of the back plate move with an appropriate speed, assuring proper arrangement of rod shaped elements in the store. This situation can last until obtaining maximum store capacity corresponding to the terminal position of the slide. Automatic emptying of the store begins at the moment, when a cleaning device following the stacked mass flow appears at the inlet of the store, the appearance causing closure of the inlet to the store by the input valve element through reducing the store capacity with the output valve element removed, owing to the movement of the slide, together with the back plate in the direction compliant with flow of the rod shaped elements through the outlet to the receiving channel with such speed as to keep the nominal pressure of mass flow in the output of the store, with the rotary lever positioned in a horizontal position along the slide, and the slide's inner conveyor with the inclined conveyor, as well as the upper and lower conveyors of the store's plates, the chain conveyor of the back plate move with an appropriate speed, assuring proper arrangement of rod shaped elements in the store. This situation last until the return of the slide to the starting point corresponding to the minimum store capacity for retaining mass flow. Then the rotating lever starts rotation towards the preliminary chamber of the store, removing the rod shaped elements from it, then continues rotation until reaching the top vertical position in the area of the end of the upper conveyor, after which the upper and lower conveyors of the plates of the store, the inner conveyor of the slide, and the chain conveyor of the back plate are stopped. The slide moves further in the direction of the flow of the rod shaped elements in the receiving channel, while the rotating lever remains in the top vertical position and removes other rod shaped elements through the outlet of the store, with the angular conveyor and the output conveyors of the receiving channel being active.

The object of the invention is the structure of the store-transport device for elongated rod shaped elements, disposed in a transfer line for elements from a delivery device to a receiving device, having a plurality of substantially horizontal, vertical and arched conveyors, and having a variable capacity store formed with the aid of the said conveyors on two neighboring levels, having one inlet and one outlet, formed by two parallel conveyors, closed with a joint back plate which is coupled with a slide separating the store levels, equipped with a separating conveyor, so that they together perform reciprocating movements parallel to the horizontal conveyors, and its concave surface, on the store side, is constituted by a chain conveyor equipped with transverse humps, and a fullness sensor is placed near the outlet. In the said device, according to the invention, an upper input conveyor has at the end an arched part pointing upwards, and a lower output conveyor has at the beginning an arched part pointing downwards, so that the two conveyors approach each other with the arched parts, but between the arched part of the upper input conveyor and the arched part of the lower output conveyor there is an in-between swing element. The horizontal separating conveyor situated on the moving slide is slipped between the arched part of the upper input conveyor and the arched part of the lower output conveyor, after deflecting the in-between swing element. Alternatively, the in-between swing element may consist of a lower in-between swing element mounted at the end of the arched part of the upper input conveyor, and of an upper in-between swing element mounted at the beginning of the arched part of the lower output conveyor, but preferably the lower in-between swing element and the upper in-between swing element may have the form of a lower in-between conveyor and an upper in-between conveyor, respectively, the lower in-between conveyor being driven by the upper input conveyor, while the upper in-between conveyor being driven by the lower output conveyor. The horizontal separating conveyor is slipped between the lower in-between swing element and the upper in-between swing element, after drawing them apart, with the lower in-between swing element is deflected downwards when slipping the separating conveyor in and the upper in-between swing element deflected upwards when slipping the separating conveyor in. Prior to slipping in the slide with the separating conveyor, the in-between swing swing element or the in-between lower and upper swing element constitute the front plate for the rod shaped elements displaced from the input channel to the output channel. The distance between the axis of a return roller of the separating conveyor and a back plate of the store is constant and equal to the radius of the back plate, while for a minimum capacity of the store, the back plate is located at a distance from the front plate corresponding to the width of the input channel and the output channel. Furthermore, the individual moving sub-assemblies or groups of moving sub-assemblies are independently driven by separate motors. The device as in the invention is characterized by simple structure, particularly in relation to state-of-the-art store-transport device while retaining many advantages of this unit.

Figure 2:
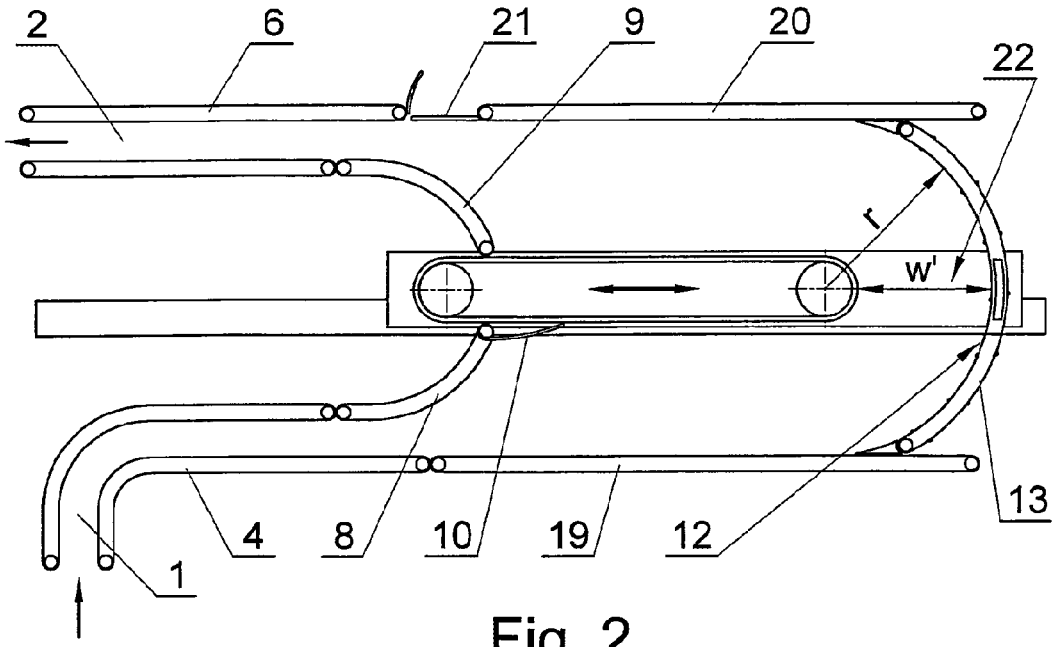
Figure 3:
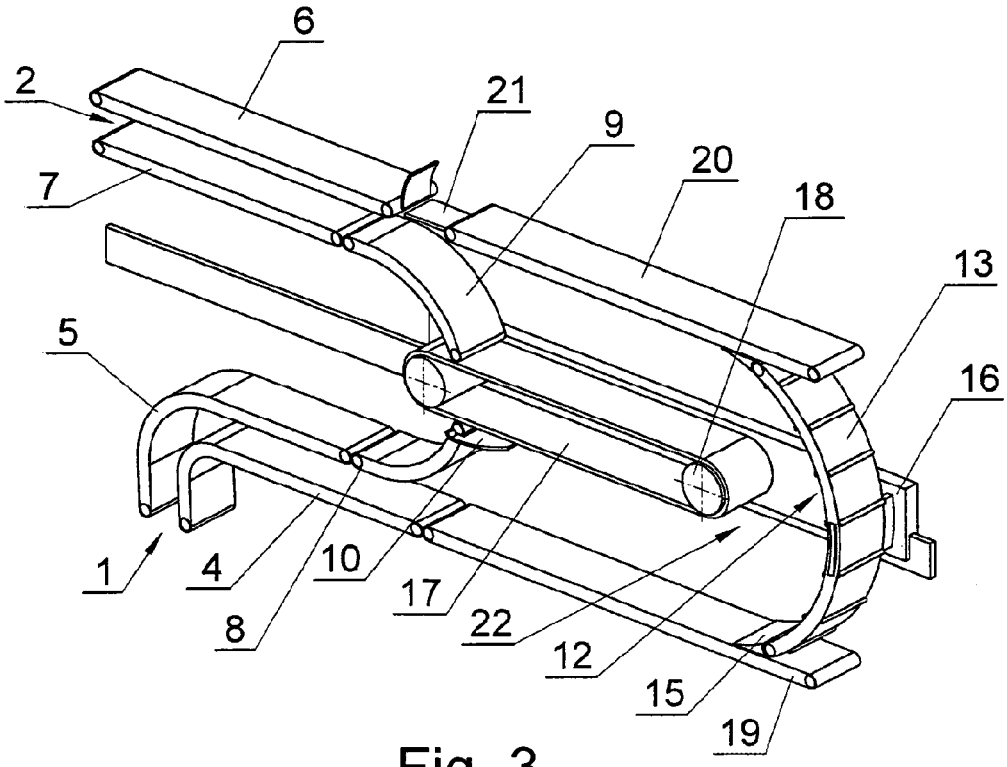
Figure 4:
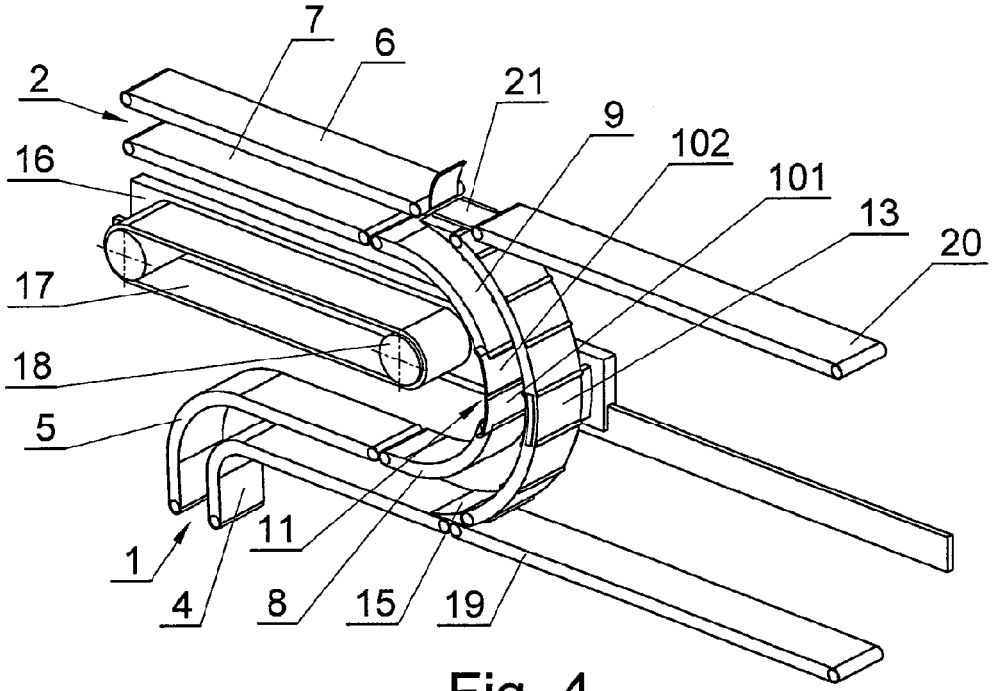
Figure 5:
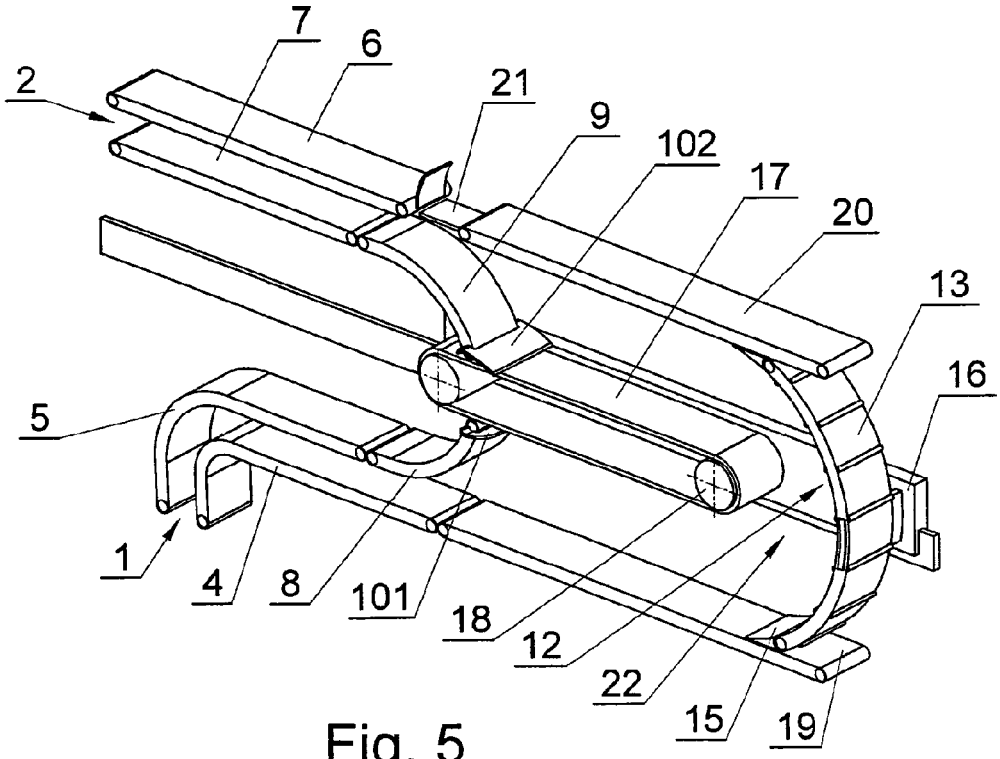
Figure 6:
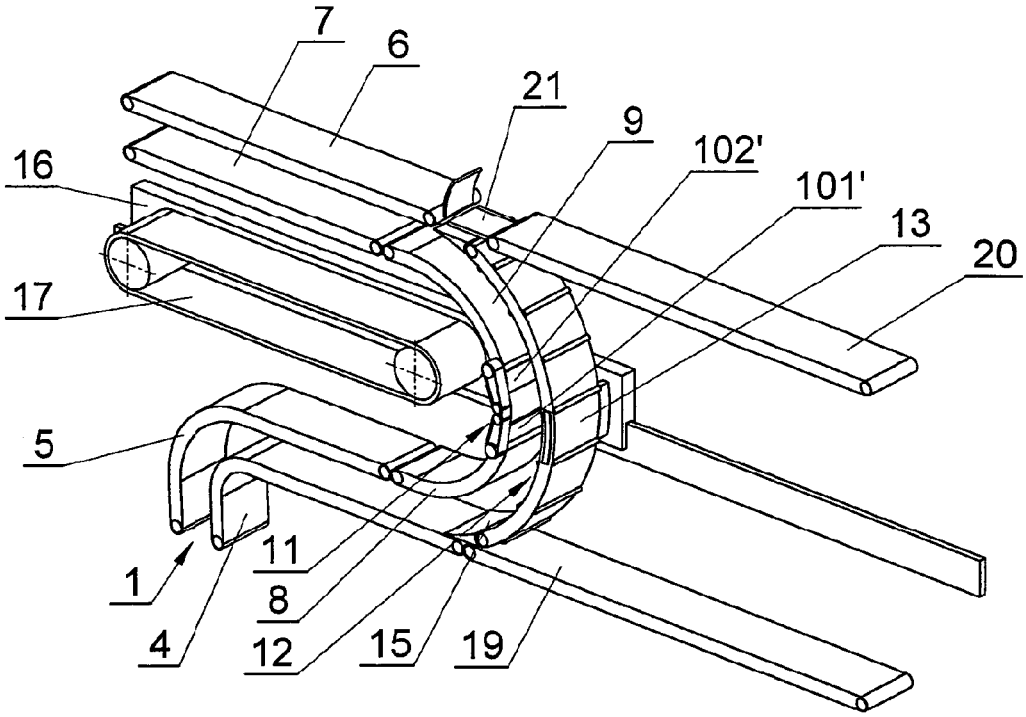
Figure 7:
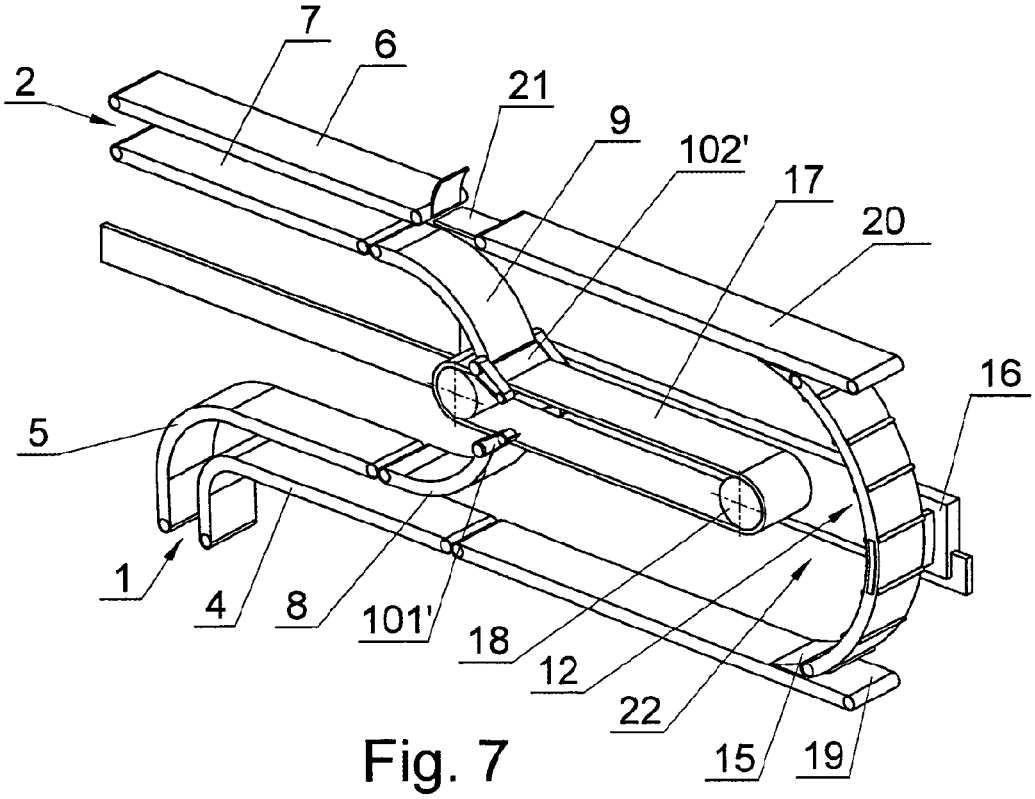

The object of the invention has been shown in an example of execution in a drawing, in which FIG. 1 presents diagrammatically the store-transport device situated in the line of displacement of rod shaped elements from a delivery device (not shown) to a receiving device (not shown) in side view at minimum store capacity, using a single-part in-between swing element, FIG. 2—the device from FIG. 1 with a maximum store capacity, FIG. 3—the device from FIG. 2 in a perspective view, FIG. 4—the store-transport device in a perspective view using a double-part in-between swing element at minimum store capacity, FIG. 5—the device as in FIG. 4 with a maximum store capacity, FIG. 6—the store-transport device in a perspective view z using a double-part in-between swing element in the form of in-between conveyors at a minimum store capacity, a FIG. 7—the device as in FIG. 6 with a maximum store capacity.

A store-transport device shown on FIG. 1 has an input channel 1 co-operating with a delivering device, and an output channel 2 co-operating with a device receiving rod shaped elements. Between the channels 1 and 2, the width of which is essentially the same, there is a variable capacity store 3. The input channel 1 is formed by a lower input conveyor 4 and an upper input conveyor 5, while the output channel 2 is formed by an upper output conveyor 6 and a lower output conveyor 7. The upper input conveyor 5 has at the end an arched part 8 pointing upwards, and the lower output conveyor 7 has at the beginning an arched part 9 pointing downwards, so that the two conveyors 8 and 9 approach each other retaining a distance, with the arched parts 8 and 9 being also conveyors. Between the arched part 8 of the upper input conveyor 5 and the arched part 9 of the lower output conveyor 7 there is an in-between swing element 10 mounted rotationally at the end of the arched part 8 so that it forms a front plate 11 of the store 3 at its minimum capacity. A back plate 12, concave on the side of the store 3 is formed by a chain conveyor 13 equipped with transverse humps 14, with the back plate 12 having at its ends skids 15, which at minimum capacity of the store 3 co-operate with the lower input conveyor 4 and the upper output conveyor 6, respectively. The back plate 12 is coupled with a slide 16 equipped with a horizontal separating conveyor 17 so that they jointly effect the to and fro motion, whereas the distance between the axis of a return roller 18 of the separating conveyor 17 and the back plate 12 of the store 3 is constant and equal to the radius r of the back plate 12, and at the minimum capacity of the store 3 the back plate 12 is located at the distance w from the front plate 11, corresponding to the width of the input channel 1 and the output channel 2. FIG. 2 presents the variable capacity store 3 at the maximum capacity, with its lower plate formed by a lower conveyor 19 being an extension of the lower input conveyor 4, and the upper plate formed by an upper conveyor 20, and between the upper conveyor 20 and the upper output conveyor 6 a fullness sensor 21 of the store 3 is located. The slide 16, situated in the horizontal axis of the device, is slipped with the separating conveyor 17 between the ends of the arched parts 8 and 9 after deflecting the in-between swing element 10, and the width w' of the throat 22, through which the stack of rod shaped elements flows from the lower level to the upper level of the store 3 corresponds to the smallest distance between the separating conveyor 17 and the chain conveyor 13 of the back plate 12. FIG. 4 and FIG. 5 present an embodiment of the device, in which the in-between swing element 10 was applied, consisting of a lower in-between swing element 101, swinging downwards, mounted rotationally at the end of the arched part 8 of the upper input conveyor 5 and an upper in-between swing element 102, swinging upwards, mounted rotationally at the beginning of the arched part 9 of the lower output conveyor 7, whereas the slide 16 with the separating conveyor 17 is slipped between the deflected ends of the in-between lower swing element 101 and the in-between upper swing element 102. FIGS. 6 and 7 present another version of the device, in which the in-between lower swing element 101 in the form of a lower in-between conveyor 101' and the in-between upper swing element 102 in the form of an or the upper in-between conveyor 102' were applied, whereas the lower in-between conveyor 101' is driven by the upper input conveyor 5 through the arched part 8, and the upper in-between conveyor 102' is driven by the lower output conveyor 7 through the arched part 9. The individual moving sub-assemblies or groups of moving sub-assemblies are independently driven by separate motors not shown in the drawing.

The operation of the store-transport device is, as follows. Prior to filling of the store 3 the slide 16 with the separating conveyor 17 is withdrawn to its terminal position, so that the distance w between the back plate 12 and the front plate 11, formed by the in-between swing element 10 aligned with both arched parts 8 and 9 or the in-between lower swing element 101 and the in-between upper swing element 102 or the lower in-between conveyor 101' and the upper in-between conveyor 102', is constant for the whole store 3 and equal to the width of the input channel 1 and the output channel 2. After activation of the delivering device, the front face of the mass flow of rod shaped elements, preceded by a cleaning element, enters the vertical part of the input channel 1, and then moves to its horizontal part, next it travels along the arch between the back plate 2 using the skid 15 and the arched part 8, and then the front plate 11. After crossing the lower level of the store 3 in the same manner the mass flow fills the upper level of the store 3 and reaches the output channel 2, and further on, the receiving device. During normal operation of the store 3 with equal throughput of the delivering device and the receiving device, the slide 16 does not change position, and in case of different throughputs of the said devices, the slide 16 changes its position, moving towards the front plate 11, which increases the capacity of the store 3. After the return roller 18 of the separating conveyor 17 reaches the front plate 11, the throat 22 of constant width w' is created between the lower and upper levels of the store 3 through which the rod shaped elements enter the upper level of the store 3. In case of need of further increase of the capacity of the store 3 the slide 16 with the separating conveyor 17 is slipped between the arched parts 8 and 9 after deflecting the in-between swing element 10 either between the in-between lower swing element 101 or the lower in-between conveyor 101' and the in-between upper swing element 102 or the upper in-between conveyor 102' after moving them apart. Displacement of mass flow of rod shaped elements is provided by the conveyors 4, 5, 6, 7, 8, 9, 13, 17, 19, 20 and alternatively 101' and 102', and facilitated by the skids 15 and the humps 14. When there is a need to reduce the capacity of the store 3 the slide 16 moves towards the position corresponding to the minimum capacity, and when there is a need to increase the capacity, it moves in the opposite direction, whereas the level of filling of the upper level of the store 3 is signaled by a fullness sensor 21. During emptying of the store 3, with the delivering device switched off, the slide 16 is displaced, until it reaches the position corresponding to the minimum capacity. Then the cleaning element is placed in the channel 1 and conveyors 4, 5, 6, 7, 8, 9, 13 and alternatively 101' and 102' are activated, and all the rod shaped elements remaining in the store 3 are removed through the output channel 2, with the cleaning element following the rod shaped elements, assuring that all the rod shaped elements are removed from the input channel 1, the store 3 and the output channel 2.

The invention claimed is:

1. A store-transport device for elongated rod shaped elements, disposed in a transfer line for elements from a delivery device to a receiving device, having a plurality of substantially horizontal, vertical and arched conveyors, and having a variable capacity store formed with the aid of the said conveyors on two neighboring levels, having one inlet and one outlet, formed by two parallel conveyors, closed with a joint back plate which is coupled with a slide separating the store levels, equipped with a separating conveyor, so that they together perform reciprocating movements parallel to the horizontal conveyors, and its concave surface, on the store side, is constituted by a chain conveyor equipped with transverse humps, and a fullness sensor is placed near the outlet, characterized in that an upper input conveyor (5) has at the end an arched part (8) pointing upwards, and a lower output conveyor (7) has at the beginning an arched part (9) pointing downwards, so that the two conveyors (5 and 7) approach each other with the arched parts (8 and 9), but between the arched part (8) of the upper input conveyor (5) and the arched part (9) of the lower output conveyor (7) there is an in-between swing element (10), and a moving slide (16) with a separating conveyor (17) is slipped between the arched part (8) of the upper input conveyor (5) and the arched part (9) of the lower output conveyor (7), after deflecting the in-between swing element (10).

2. A device as in claim 1, characterized in that the in-between swing element (10) consists of a lower in-between swing element (101) mounted at the end of the arched part (8) of the upper input conveyor (5) and an upper in-between swing element (102) mounted at the end of the arched part (9) of the lower output conveyor (7).

3. A device as in claim 2, characterized in that the in-between swing element (101) has the form of a lower in-between conveyor (101'), and the upper in-between swing element (102) has the form of an upper in-between conveyor (102').

4. A device as in claim 3, characterized in that the lower in-between conveyor (101') is driven by the upper input conveyor (5).

5. A device as in claim 4, characterized in that the upper in-between conveyor (102') is driven by the lower output conveyor (7).

6. A device as in claim 2, characterized in that the horizontal separating conveyor (17) is slipped between the lower in-between swing element (101) and the upper in-between swing element (102), after drawing them apart.

7. A device as in claim 6, characterized in that the lower in-between swing element (101) is deflected downwards when slipping the separating conveyor (17) in.

8. A device as in claim 6, characterized in that the upper in-between swing element (102) is deflected upwards when slipping the separating conveyor (17) in.

9. A device as in claim 1, characterized in that prior to slipping in the slide (16) with the separating conveyor (17), the in-between swing element (10) or the in-between lower (101) and upper (102) swing element constitute the front plate (11) for the rod shaped elements displaced from the input channel (1) to the output channel (2).

10. A device as in claim 1, characterized in that the distance between the axis of a return roller (18) of the separating conveyor (17) and a back plate (12) of the store (3) is constant and equal to the radius (r) of the back plate (12).

11. A device as in claim 1, characterized in that for a minimum capacity of the store (3), the back plate (12) is located at the distance (w) from the front plate (11), corresponding to the width of the input channel (1) and the output channel (2).

12. A device as in claim 4, characterized in that the individual moving sub-assemblies or groups of moving sub-assemblies are independently driven by separate motors.

13. A device as in claim 3, characterized in that the horizontal separating conveyor (17) is slipped between the lower in-between swing element (101) and the upper in-between swing element (102), after drawing them apart.

14. A device as in claim 2, characterized in that prior to slipping in the slide (16) with the separating conveyor (17), the in-between swing element (10) or the in-between lower (101) and upper (102) swing element constitute the front plate (11) for the rod shaped elements displaced from the input channel (1) to the output channel (2).

15. A device as in claim 10, characterized in that for a minimum capacity of the store (3), the back plate (12) is located at the distance (w) from the front plate (11), corresponding to the width of the input channel (1) and the output channel (2).

16. A device as in claim 5, characterized in that the individual moving sub-assemblies or groups of moving sub-assemblies are independently driven by separate motors.

* * * * *